US006640843B2

(12) United States Patent
Lee

(10) Patent No.: US 6,640,843 B2
(45) Date of Patent: Nov. 4, 2003

(54) INK REFILLING APPARATUS AND METHOD FOR CARTRIDGE OF INK JET PRINTER

(76) Inventor: Yong-Soo Lee, Chungspmg Bldg., 21-7, Chungdam-dong, Kangnam-gu, Seoul (KR), 135-102

( * ) Notice: Subject to any disclaimer, the term of this patent is extended or adjusted under 35 U.S.C. 154(b) by 0 days.

(21) Appl. No.: 10/049,169

(22) PCT Filed: Jun. 19, 2001

(86) PCT No.: PCT/KR01/01042

§ 371 (c)(1),
(2), (4) Date: Jun. 17, 2002

(87) PCT Pub. No.: WO02/26502

PCT Pub. Date: Apr. 4, 2002

(65) Prior Publication Data

US 2003/0056850 A1 Mar. 27, 2003

(51) Int. Cl.[7] ..... B65B 1/04

(52) U.S. Cl. ..... 141/18; 141/2; 141/116; 141/366; 141/375; 141/383; 347/85

(58) Field of Search ..... 141/2, 18, 115, 141/116, 363, 366, 372, 375, 379, 383, 384, 386; 347/85, 86

(56) References Cited

U.S. PATENT DOCUMENTS 5,495,877 A * 3/1996 Schwenk et al. ..... 141/370
5,581,287 A * 12/1996 Baezner et al. ..... 347/85
6,213,597 B1 * 4/2001 Liu ..... 347/85

* cited by examiner

*Primary Examiner*—Gregory L. Huson
*Assistant Examiner*—Peter deVore

(57) ABSTRACT

An ink refilling apparatus for a cartridge of an ink jet printer comprises an injector and a refill holder. The injector includes a cylinder containing ink and a piston inserted into the cylinder. An ejecting protrusion having an ejection hole is formed at the cylinder. An enclosing protrusion surrounding the ejecting protrusion is formed at the cylinder, and is formed with a female screw around the inner periphery. The refill holder includes a base onto which a cartridge is seated. First and second supporting walls are bent vertically from both ends of the base to support the cartridge. An inserting protrusion having a male screw around the outer periphery to be teeth-engaged with the female screw of the injector is bonded to the first wall of the refill holder. An ink injection passage is formed through the inserting protrusion to communicate with an injection hole of the cartridge.

14 Claims, 6 Drawing Sheets

INK REFILLING APPARATUS AND METHOD FOR CARTRIDGE OF INK JET PRINTER

BACKGROUND OF THE INVENTION

1. Field of the Invention

The present invention relates to ink refilling apparatus and method, and more particularly, to ink refilling apparatus and method for a cartridge of an ink jet printer for refilling an ink jet printer cartridge and regulating inner pressure thereof.

2. Description of the Related Art

Generally, a black and white ink jet printer cartridge contains liquid ink of one color, and a color ink jet printer cartridge contains liquid inks of three colors or more. The ink jet printer cartridges are produced in various designs by manufacturers, and mostly designed to be refilled.

The ink cartridge is classified into a sponge-insertion type and an automatic pressure-control type, according to its inner structure. The sponge-insertion type is provided with a polyurethane sponge for containing the ink in the cartridge, and the automatic pressure-control type with air bags for maintaining ink ejection pressure uniform in the cartridge.

FIG. 7 shows a conventional method of refilling one color ink cartridge. A cartridge 101 includes a case 104 which is formed with an injection hole 102 for injecting the ink therein and a nozzle 103 for ejecting the ink at one side surface of the case 104, and a cap 105 which is coupled to the other side surface of the case 104. The cap 105 is formed with an air-flow hole (not shown) through which external air is injected into air bags (not shown) in the case 104.

In order to refill the above ink cartridge 101, a needle of an injector 106 containing the liquid ink is inserted into the injection hole 102, and then a piston 106*a* is pushed to expel the ink from the injector 106. After the injector 106 is removed from the cartridge 101, the injection hole 102 is blocked, and a predetermined amount of external air is injected into the air bags in the case 104 through the air-flow hole formed at the cap 105, by means of another injector. Thereby, the inner pressure of the cartridge 101 is adequately adjusted, and the refilling steps are eventually completed.

However, the above conventional refilling method has problems due to troublesome refilling steps and the risk of a messy ink spill. Also, the cartridge which is not used for a long time can not be refilled by the conventional method, because the ink remaining at the nozzle solidifies, and thus the nozzle becomes blocked.

SUMMARY OF THE INVENTION

It is an object of the present invention to provide an ink refilling apparatus and method for a cartridge of an ink jet printer by which an ink cartridge can be more easily and conveniently refilled and the ink is prevented from leaking or being spilled on user's clothes or hands.

In order to achieve the above object, the present invention provides an ink refilling apparatus for a cartridge of an ink jet printer for refilling a cartridge including a case storing ink, an injection hole through which the ink is injected into the case and a nozzle for ejecting the ink, comprising:

an injector including a cylinder containing the ink, an ejecting protrusion formed integrally at an end of the cylinder and having an ejection hole, an enclosing protrusion formed integrally at the end of the cylinder while surrounding the ejecting protrusion and being spaced apart therefrom and formed with a female screw around the inner periphery, and a piston inserted into the cylinder for ejecting the ink in the cylinder; and a refill holder including a base onto which the cartridge is fittingly seated, a first supporting wall which is bent vertically from an end of the base to contactingly support one surface of the cartridge and is formed with a mounting hole which communicates with the injection hole of the cartridge, a second supporting wall which is bent vertically from the other end of the base to contactingly support the other surface of the cartridge, and a coupling member which is fitted into the mounting hole.

The coupling member includes a coupling protrusion which is insertedly bonded to the mounting hole, a contacting plate which is integrally formed at the coupling protrusion while being larger than the coupling protrusion and contacts the outer surface of the first supporting wall, an inserting protrusion which is integrally formed at the contacting plate and formed with a male screw around the outer periphery to be teeth-engaged with the female screw of the injector, and an ink injection passage which is formed through the coupling protrusion, the contacting plate and the inserting protrusion in an axial direction and communicates with the injection hole of the cartridge.

The ink refilling apparatus further comprises an exhaust holder including a base onto which the cartridge is fittingly seated, a first supporting wall which is bent vertically from an end of the base to contactingly support one surface of the cartridge and is formed with a mounting hole which communicates with the nozzle of the cartridge, a second supporting wall which is bent vertically from the other end of the base to contactingly support the other surface of the cartridge, and a coupling member which is fitted into the mounting hole.

The coupling member including a coupling protrusion which is insertedly bonded to the mounting hole, a contacting plate which is integrally formed at the coupling protrusion while being larger than the coupling protrusion and contacts the outer surface of the first supporting wall, an inserting protrusion which is integrally formed at the contacting plate and formed with a male screw around the outer periphery to be teeth-engaged with the female screw of the injector, and an ink exhaust passage which is formed through the coupling protrusion, the contacting plate and the inserting protrusion in an axial direction and communicates with the nozzle of the cartridge.

An ink refilling method comprises the steps of:

(S1) providing an injector which includes a cylinder containing ink and being formed with an ejecting protrusion and an enclosing protrusion surrounding the ejecting protrusion and a piston inserted into the cylinder, and a refill holder which includes an inserting protrusion coupled to the enclosing protrusion of the injector and is formed with an ink injection passage at the inserting protrusion;

(S2) mounting the cartridge to the refill holder such that the injection hole of the cartridge communicates with the ink injection passage of the refill holder;

(S3) inserting the ejecting protrusion of the injector into the ink injection passage of the refill holder;

(S4) injecting the ink into the cartridge through the ink injection passage and the injection hole by pushing the piston of the injector toward the ejecting protrusion;

(S5) regulating inner pressure of the cartridge by drawing the piston from the ejecting protrusion to extract a predetermined amount of ink from the cartridge through the injection hole;

(S6) demounting the cartridge from the refill holder;

(S7) providing an exhaust holder which includes an inserting protrusion coupled to the enclosing protrusion of the injector and is formed with an ink exhaust passage at the inserting protrusion;

(S8) mounting the cartridge to the exhaust holder such that the nozzle of the cartridge communicates with the ink exhaust passage of the exhaust holder;

(S9) inserting the ejecting protrusion of the injector into the ink exhaust passage of the exhaust holder;

(S10) extracting a predetermined amount of ink from the cartridge through the nozzle by drawing the piston from the ejecting protrusion; and (S11) demounting the cartridge from the exhaust holder.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENTS

Hereinafter, an ink refilling apparatus for a cartridge of an ink jet printer according to a preferred embodiment of the present invention will be described in detail with reference to FIGS. 1 to 3.

Although the ink refilling apparatus of the present invention can be applied to all kinds of ink cartridges, the inventive refilling apparatus used for the automatic pressure-control type cartridge will be described.

Figure 1:
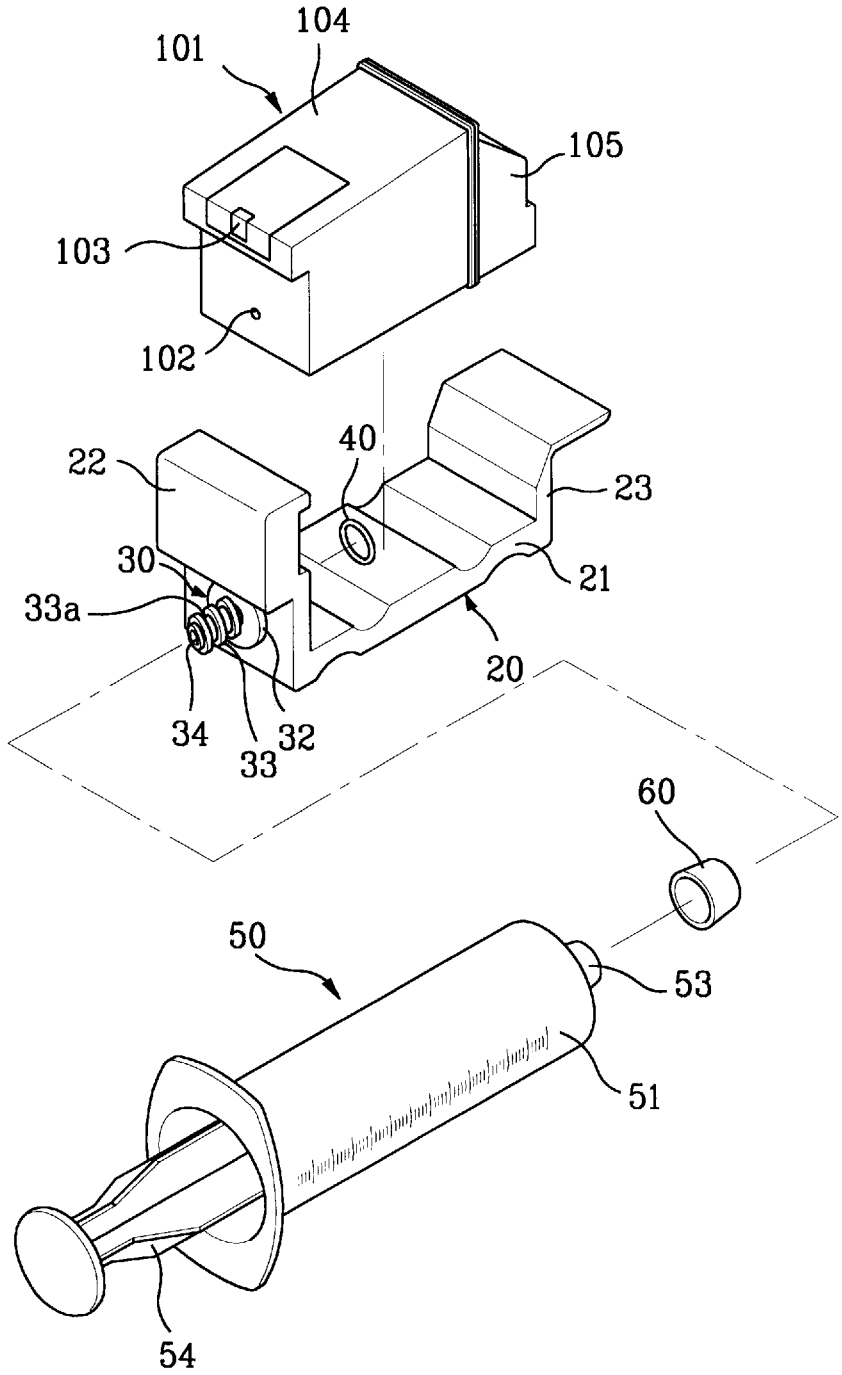
FIG. 1 is an exploded perspective view of a refill holder and an injector of an ink refilling apparatus for a cartridge of an ink jet printer according to the present invention.
Figure 2:
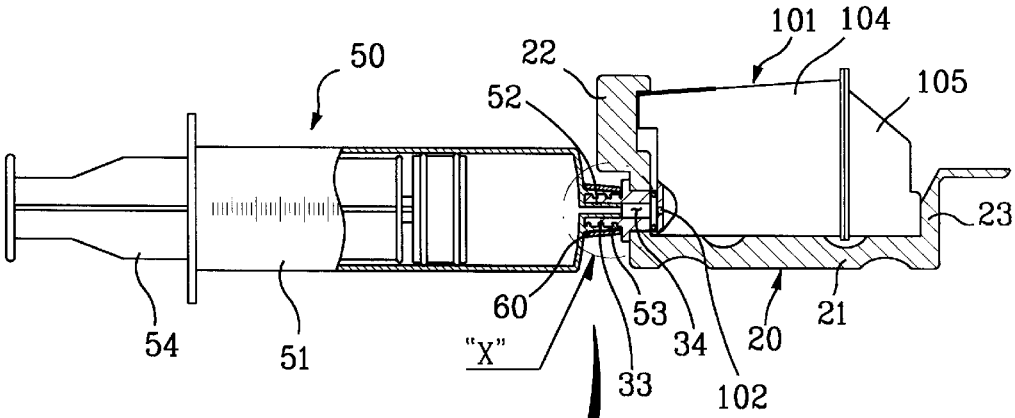
FIG. 2 is a front sectional view of the refill holder and the injector in FIG. 1.
Figure 2A:
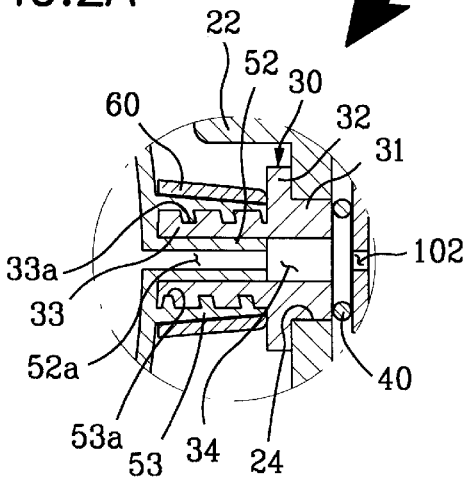
FIG. 2A is an enlarged view of X-portion in FIG. 2.
Figure 3:
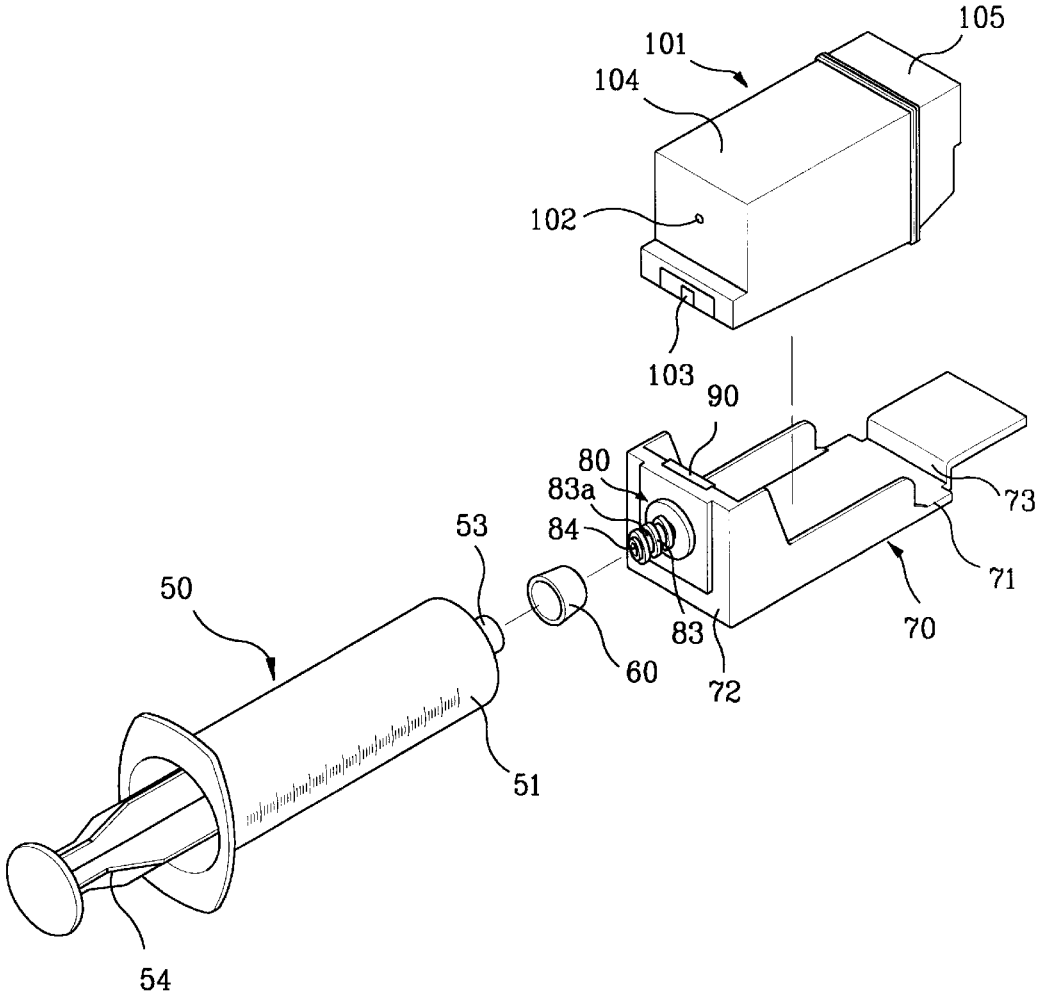
FIG. 3 is an exploded perspective view of an exhaust holder and an injector of an ink refilling apparatus for a cartridge of an ink jet printer according to the present invention.
Figure 4:
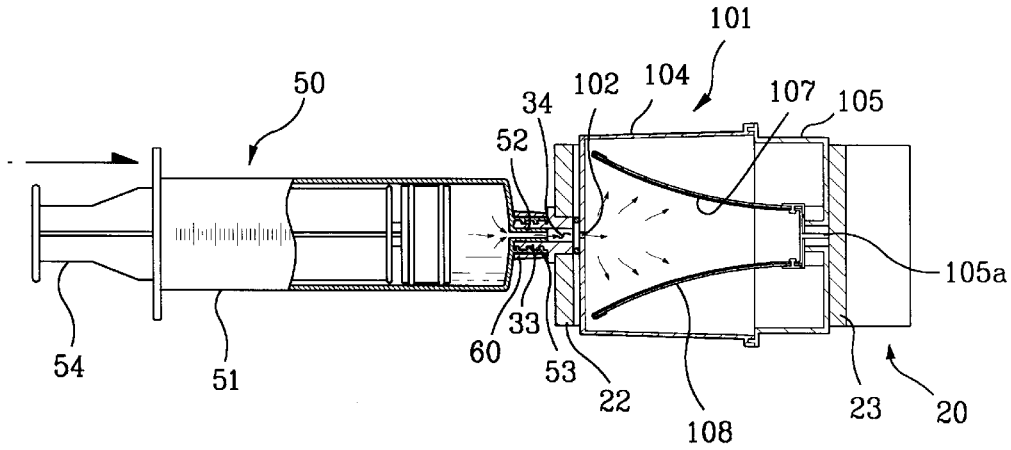
FIG. 4 is a plan sectional view showing a process of injecting the ink by using the refill holder.
Figure 5:
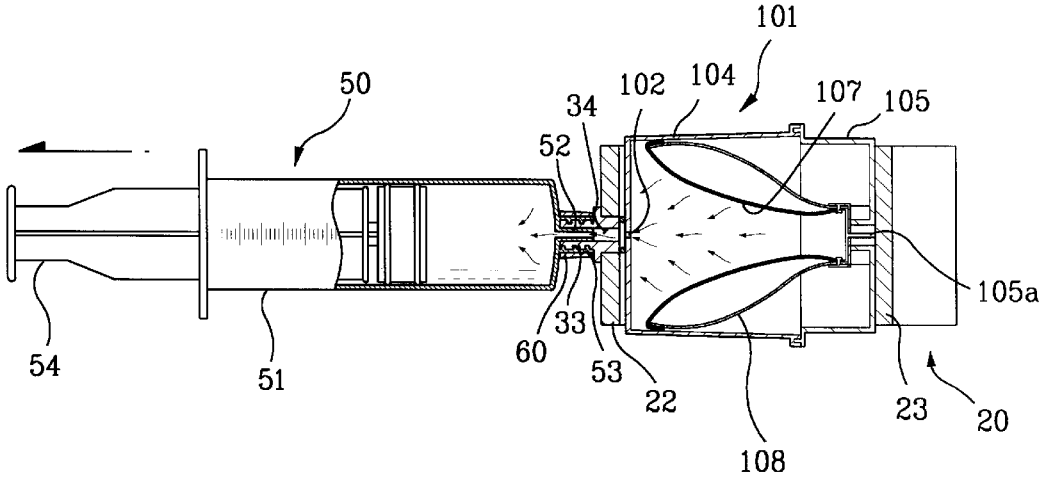
FIG. 5 is a plan sectional view showing a process of regulating an inner pressure of the cartridge by using the refill holder.

As shown in FIGS. 1 and 2, the inventive ink refilling apparatus includes a refill holder 20 to which a cartridge 101 for an ink jet printer is detachably mounted, and an injector 50 which refills the ink cartridge 101 through an injection hole 102 formed at the cartridge 101.

Described more in detail, the refill holder 20 includes a base 21 onto which a case 104 and a cap 105 of the cartridge 101 are fittingly seated, a first supporting wall 22 which is bent vertically from an end of the base 21, and a second supporting wall 23 which is bent vertically from the other end of the base 21. The first supporting wall 22 contacts closely a surface of the case 104 formed with the injection hole 102 to support the same, and the second supporting wall 23 contacts closely a surface of the cap 105 to support the same.

A circular mounting hole 24 is formed at the first supporting wall 22. A coupling member 30 is fitted into the mounting hole 24 so as to couple the injector 50 to the refill holder 20. The diameter of the mounting hole 24 is larger than that of the injection hole 102, so that the injection hole 102 can be easily positioned corresponding to the mounting hole 24 when the cartridge 101 is mounted to the refill holder 20.

The coupling member 30 includes a coupling protrusion 31 which is insertedly bonded to the mounting hole 24 of the first supporting wall 22, a circular contacting plate 32 which is integrally formed at an end of the protrusion 31 while being larger than the protrusion 31 and contacts the outer surface of the first supporting wall 22, and an inserting protrusion 33 which is integrally formed at the plate 32 and is inserted into the injector 50. An ink injection passage 34 is formed through the coupling protrusion 31, the contacting plate 32 and the inserting protrusion 33 in an axial direction. A male screw 33*a* is formed around the outer peripheral surface of the inserting protrusion 33. When the cartridge 101 is mounted to the refill holder 20, the ink injection passage 34 communicates with the injection hole 102 of the cartridge 101. In addition, a packing member 40, e.g. an O-ring, is bonded to the coupling protrusion 31, opposite to the injection hole 102 of the cartridge 101, while surrounding the passage 34 and the hole 102, so as to prevent the liquid ink from leaking.

The injector 50 for injecting the ink into the cartridge 101 includes a cylinder 51 and a piston 54. An ejecting protrusion 52 having an ejection hole 52*a* is integrally formed at an end of the cylinder 51. By the piston 54 performing a linear reciprocating motion in the cylinder 51, the ink in the cylinder 51 is ejected outside.

An enclosing protrusion 53 is integrally formed at the end of the cylinder 51 while surrounding the ejecting protrusion 52 and being spaced apart therefrom. When the injector 50 is coupled to the refill holder 20, the inserting protrusion 33 of the coupling member 30 is inserted into the enclosing protrusion 53. A female screw 53*a*, which is teeth-engaged with the male screw 33*a* of the inserting protrusion 33, is formed around the inner peripheral surface of the enclosing protrusion 53.

The enclosing protrusion 53 is formed in a taper shape such that the diameter becomes smaller as it goes from the cylinder 51 to its free end, so that the ink passing through the injection passage 34 from the injector 50 is prevented from leaking through a gap between the protrusions 53 and 33. In order to enhance the leakage-preventing effect, a suppressing hoop 60, formed in the same taper shape as the enclosing protrusion 53, is provided around the protrusion 53. The protrusion 53 is forcedly fitted into the suppressing hoop 60. The suppressing hoop 60 prevents generation of a gap which may be formed between the protrusions 33 and 53 due to elasticity of the enclosing protrusion 53 as the inserting protrusion 33 proceeds inward of the enclosing protrusion 53 by the screw-engagement.

After the ink cartridge 101 is refilled by using the above-structured refill holder 20 and injector 50, the cartridge 101 is optimized such that the ink is smoothly ejected right after the refilled cartridge 101 is mounted to the printer to achieve clean and clear printing initially, by extracting a predetermined amount of ink from the cartridge 101 through the nozzle 103. For this, as shown in FIG. 3, the inventive ink refilling apparatus further includes an exhaust holder 70 for exhausting the injected ink from the cartridge 101 through the nozzle 103.

The exhaust holder 70, similar to the refill holder 20, includes a base 71, a first supporting wall 72, a second supporting wall 73, and a coupling member 80. The shape and function of the exhaust holder 70 are almost the same as those of the refill holder 20, so the description thereof is omitted.

However, the first supporting wall 72 of the exhaust holder 70 supports the surface of the case 104 where the nozzle 103 is formed, and an ink exhaust passage 84 which is formed through the first supporting wall 72 and the coupling member 80 communicates with the nozzle 103. Also, a rectangular packing plate 90, which is formed with a slot 91 (see FIG. 6A) communicating with the nozzle 103, adheres to the coupling protrusion 81 (see FIG. 6A) and an inner surface of the first wall 72 opposed to the nozzle 103 of the cartridge 101. This packing plate 90 prevents any leakage of the ink passing through the passage 84 from the nozzle 103, and protects the nozzle 103 from the exterior shock.

Hereinafter, the inventive ink refilling method using the ink refilling apparatus for a cartridge of an ink jet printer will be described with reference to FIGS. 2 to 6.

The ink cartridge of an automatic pressure-control type to which the inventive ink refilling apparatus is applied is provided with a pair of air bags 107 inside the case 104. Plate springs 108 are attached to outer side surfaces of the respective air bags 107 while being curved toward a central portion of the case 104. The openings of the air bags 107 are fixed to the cap 105 so as to communicate with an air-flow hole 105*a* formed at the cap 105. The mutual operative relationship of the air bags 107, the plate springs 108 and the inventive ink refilling apparatus will be described later.

First, when the ink in the cartridge 101 mounted in a printer(not shown) is totally expended, the cartridge 101 is demounted from the printer. If the cartridge 101 is pushed down in the state of being positioned between the first and second supporting walls 22 and 23 of the refill holder 20, the bottom surfaces of the case 104 and the cap 105 are seated on the base 21 of the refill holder 20, and the case 104 and the cap 105 are detachably mounted to the refill holder 20 while being supported by the first and second walls 22 and 23.

At this time, the injection hole 102 of the cartridge 101 is aligned with the ink injection passage 34 formed through the coupling member 30, so as to communicate therewith.

Then, the suppressing hoop 60 is coupled around the outer periphery of the enclosing protrusion 53 of the injector 50 which is filled with the ink, and the enclosing protrusion 53 is located at a front end of the inserting protrusion 33 of the coupling member 30. By revolving the injector 50, the inserting protrusion 33 is contactingly inserted into the enclosing protrusion 53 by the teeth-engagement of the female screw 53*a* formed on the inner periphery of the enclosing protrusion 53 and the male screw 33*a* formed on the outer periphery of the inserting protrusion 33. At the same time, the ejecting protrusion 52 surrounded by the enclosing protrusion 53 is inserted into the ink injection passage 34 of the coupling member 30.

On the other hand, the taper-shaped suppressing hoop 60 which is coupled around the outer periphery of the enclosing protrusion 53 prevents the ink from leaking through a gap which may be formed between the protrusions 33 and 53 due to elasticity of the enclosing protrusion 53 as the inserting protrusion 33 proceeds inward of the enclosing protrusion 53 by the screw-engagement.

After coupling the injector 50 to the refill holder 20 in the above order, the piston 54 is pushed toward the ejecting protrusion 52 of the cylinder 51 while compressing the interior of the cylinder 51 by constant pressure. As a result, the ink stored in the cylinder 51 is injected into the case 104 of the cartridge 101 via the ejecting protrusion 52, the ink injection passage 34 of the coupling member 30 and the injection hole 102 of the cartridge 101.

After the ink is injected into the cartridge 101 as above, the inner pressure of the cartridge 101 must be regulated so that the ink can be ejected uniformly through the nozzle 103. The inner pressure regulating process will be described hereinafter with reference to FIG. 5.

When drawing the piston 54 outward, a space between the injection hole 102 of the cartridge 101 and the front end of the ejecting protrusion 52 of the cylinder 51 is transformed into a vacuum.

In this state, a predetermined amount of ink(about 2 to 10 cc, preferably 2 cc) is extracted from the cartridge 101 through the injection hole 102 by repeatedly pushing and drawing the piston 54 several times, to thereby generate a negative pressure in the case 104. By this, external air flows into the cartridge 101 through the air-flow hole 105*a* formed at the cap 105, and enters the air bags 107 which communicate with the air-flow hole 105*a*. Accordingly, the air bags 107 swell out, and thus the plate springs 108 attached to the outer side surfaces of the air bags 107 are deformed to be curved toward the both side walls of the case 104, to thereby complete the inner pressure regulating process of the cartridge 101. The air in the bags 107 flows out gradually through the air-flow hole 105*a* of the cap 105 by the elastic restoring force of the plate spring 108 as much as the ink is used. As a result, since the inner pressure of the cartridge 101 is maintained uniform regardless of the amount of the consumed ink, the ink is ejected constantly through the nozzle 103.

The space between the ejecting protrusion 52 of the injector 50 and the injection hole 102 of the cartridge 101, through which the ink passes when injecting the ink and regulating the inner pressure, is sealed perfectly by the O-ring 40 adhering to the coupling member 30 and the hoop 60 suppressing the outer periphery of the enclosing protrusion 53 of the injector 50, so the ink is prevented from being spilled or splashed on user's clothes or hands, etc.

Figure 6:
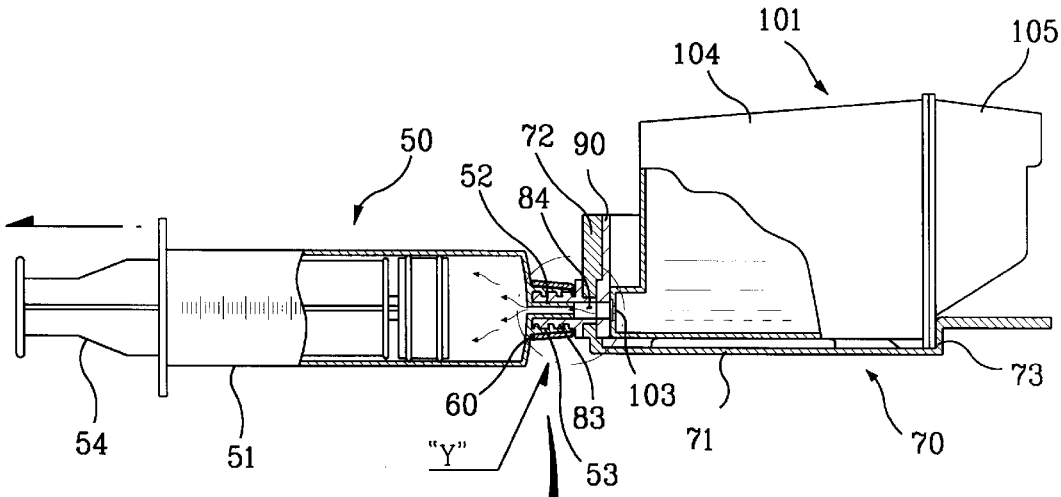
FIG. 6 is a front sectional view showing a process of exhausting the ink from the cartridge by using the exhaust holder.

The cartridge 101, into which the ink is injected and the inner pressure of which is completely regulated by the above processes, is demounted from the refill holder 20, and is detachably mounted to the exhaust holder 70 while being supported by the first and second walls 72 and 73, as shown in FIG. 6.

Figure 6A:
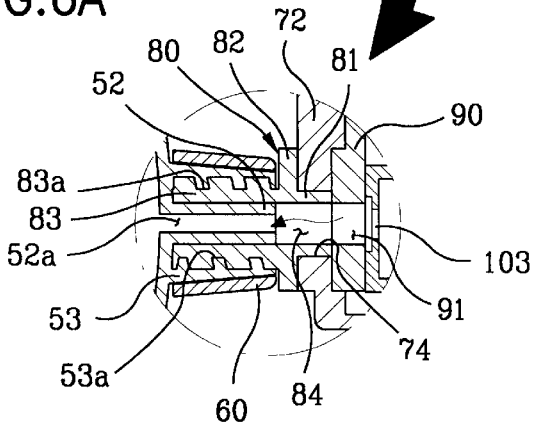
FIG. 6A is an enlarged view of Y-portion in FIG. 6.
Figure 7:
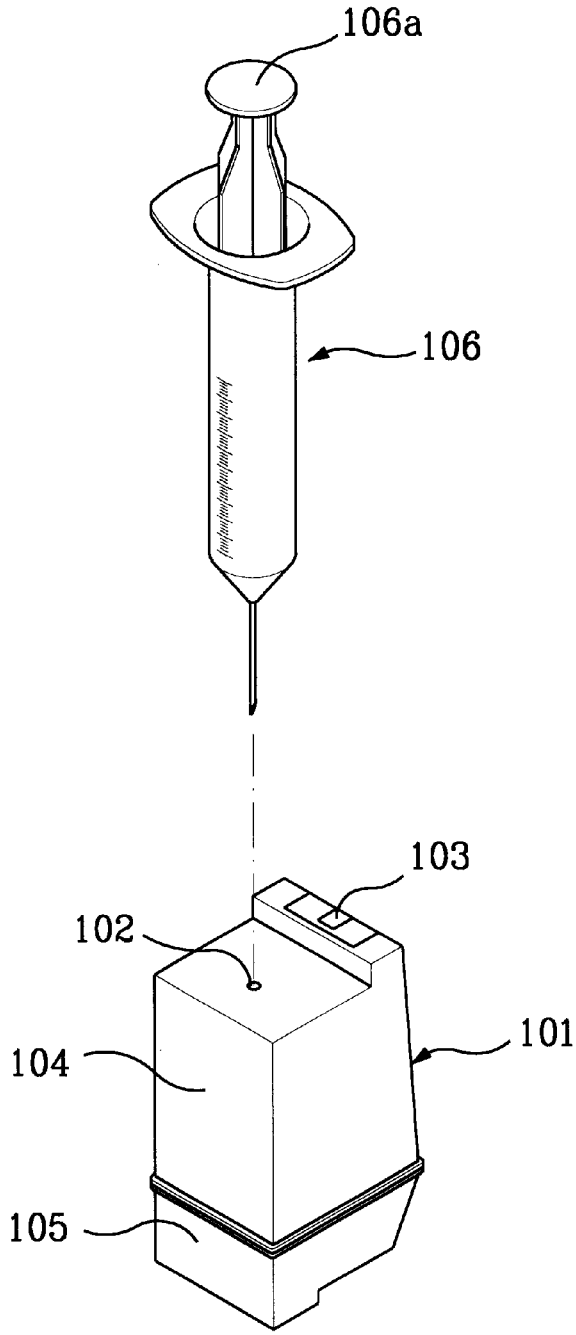
FIG.7 (PRIOR ART)
FIG. 7 is a perspective view of a conventional method of refilling the ink cartridge of the ink jet printer.

The nozzle 103 of the cartridge 101 is aligned with the ink exhaust passage 84 formed through the coupling protrusion 81, contacting plate 82 and inserting protrusion 83, so as to communicate therewith, as shown in FIG. 6A.

In this state, the injector 50 is coupled to the exhaust holder 70 by the teeth-engagement of the female screw 53*a* formed on the inner periphery of the enclosing protrusion 53 and the male screw 83*a* formed on the outer periphery of the inserting protrusion 83.

After that, the piston 54 is drawn outward to extract a predetermined amount of ink(about 2 to 10 cc, preferably 2 cc) from the cartridge 101 through the nozzle 103, thus the ink in the cartridge 101 accumulates accurately at the nozzle 103. As a result, the cartridge 101 is optimized such that the ink is smoothly ejected right after the refilled cartridge 101 is mounted to the printer, to thereby achieve the clean and clear printing initially.

In addition, the above operation of expelling the ink through the nozzle 103 by using the exhaust holder 70 easily causes the ink to run through the nozzle 103 which has been left to dry up for a long time.

The ink flowing from the nozzle 103 of the cartridge 101 to the ejecting protrusion 52 of the injector 50 when exhausting the ink is prevented from leaking or being splashed on user's clothes or hands, etc. by the packing plate 90 adhering to the coupling protrusion 81 and the hoop 60 suppressing the outer periphery of the enclosing protrusion 53 of the injector 50.

As described above in detail, according to the inventive ink refilling apparatus and method for a cartridge of an ink jet printer, the ink injecting and inner pressure regulating processes can be easily and conveniently performed by only coupling the injector to the refill holder one time, and any leakage of the ink to be injected and exhausted is readily prevented by using the screw-engagement and suppressing hoop between the injector and the refill holder.

Also, before the refilled cartridge is mounted to a printer, extracting a predetermined amount of ink from the cartridge through the nozzle by using the exhaust holder optimizes the cartridge, and causes the ink to run through the nozzle which has been left to dry up for a long time.

In addition, when the inventive exhaust holder is applied to a color ink cartridge to extract a predetermined amount of ink through the nozzle, since the color-mixed ink existing near the nozzle is previously exhausted, the ink of each color is ejected cleanly and clearly without mixing initially.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. An ink refilling apparatus for a cartridge of an ink jet printer for refilling a cartridge including a case storing ink, an injection hole through which the ink is injected into the case and a nozzle for ejecting the ink, comprising:

an injector including a cylinder containing the ink, an ejecting protrusion formed integrally at an end of the cylinder and having an ejection hole, an enclosing protrusion formed integrally at the end of the cylinder while surrounding the ejecting protrusion and being spaced apart therefrom and formed with a female screw around the inner periphery, and a piston inserted into the cylinder for ejecting the ink in the cylinder; and a refill holder including a base onto which the cartridge is fittingly seated, a first supporting wall which is bent vertically from an end of the base to contactingly support one surface of the cartridge and is formed with a mounting hole which communicates with the injection hole of the cartridge, a second supporting wall which is bent vertically from the other end of the base to contactingly support the other surface of the cartridge, and a coupling member which is fitted into the mounting hole, the coupling member including a coupling protrusion which is insertedly bonded to the mounting hole, a contacting plate which is integrally formed at the coupling protrusion while being larger than the coupling protrusion and contacts the outer surface of the first supporting wall, an inserting protrusion which is integrally formed at the contacting plate and formed with a male screw around the outer periphery to be teeth-engaged with the female screw of the injector, and an ink injection passage which is formed through the coupling protrusion, the contacting plate and the inserting protrusion in an axial direction and communicates with the injection hole of the cartridge.

2. The ink refilling apparatus for a cartridge of an ink jet printer as claimed in claim 1, wherein the enclosing protrusion of the injector is formed in a taper shape such that a diameter becomes smaller as it goes from the cylinder to a free end, and a suppressing hoop, into which the enclosing protrusion is forcedly fitted, is provided around the enclosing protrusion.

3. The ink refilling apparatus for a cartridge of an ink jet printer as claimed in claim 2, wherein the suppressing hoop is formed in the same taper shape as the enclosing protrusion.

4. The ink refilling apparatus for a cartridge of an ink jet printer as claimed in claim 1, wherein a packing member is bonded to the coupling protrusion of the refill holder, opposite to the injection hole of the cartridge, while surrounding the ink injection passage.

5. The ink refilling apparatus for a cartridge of an ink jet printer as claimed in claim 1, further comprising an exhaust holder including a base onto which the cartridge is fittingly seated, a first supporting wall which is bent vertically from an end of the base to contactingly support one surface of the cartridge and is formed with a mounting hole which communicates with the nozzle of the cartridge, a second supporting wall which is bent vertically from the other end of the base to contactingly support the other surface of the cartridge, and a coupling member which is fitted into the mounting hole, the coupling member including a coupling protrusion which is insertedly bonded to the mounting hole, a contacting plate which is integrally formed at the coupling protrusion while being larger than the coupling protrusion and contacts the outer surface of the first supporting wall, an inserting protrusion which is integrally formed at the contacting plate and formed with a male screw around the outer periphery to be teeth-engaged with the female screw of the injector, and an ink exhaust passage which is formed through the coupling protrusion, the contacting plate and the inserting protrusion in an axial direction and communicates with the nozzle of the cartridge.

6. The ink refilling apparatus for a cartridge of an ink jet printer as claimed in claim 5, wherein a rectangular packing member, which is formed with a slot communicating with the nozzle of the cartridge, is bonded to the coupling protrusion of the exhaust holder, opposite to the nozzle.

7. An ink refilling method for a cartridge of an ink jet printer for refilling a cartridge including a case storing ink, an injection hole through which the ink is injected into the case and a nozzle for ejecting the ink, comprising the steps of:

(S1) providing an injector which includes a cylinder containing ink and being formed with an ejecting protrusion and an enclosing protrusion surrounding the ejecting protrusion and a piston inserted into the cylinder, and a refill holder which includes an inserting protrusion coupled to the enclosing protrusion of the injector and is formed with an ink injection passage at the inserting protrusion;

(S2) mounting the cartridge to the refill holder such that the injection hole of the cartridge communicates with the ink injection passage of the refill holder;

(S3) inserting the ejecting protrusion of the injector into the ink injection passage of the refill holder;

(S4) injecting the ink into the cartridge through the ink injection passage and the injection hole by pushing the piston of the injector toward the ejecting protrusion;

(S5) regulating inner pressure of the cartridge by drawing the piston from the ejecting protrusion to extract a predetermined amount of ink from the cartridge through the injection hole; and (S6) demounting the cartridge from the refill holder.

8. The ink refilling method for a cartridge of an ink jet printer as claimed in claim 7, wherein in the step of inserting(S3), the enclosing protrusion of the injector is located at a front end of the inserting protrusion of the refill holder, and the inserting protrusion is contactingly inserted into the enclosing protrusion by the teeth-engagement of a female screw formed on the inner periphery of the enclosing protrusion and a male screw formed on the outer periphery of the inserting protrusion by revolving the injector.

9. The ink refilling method for a cartridge of an ink jet printer as claimed in claim 8, wherein the step of inserting (S3) includes a step of forcedly coupling a suppressing hoop around the enclosing protrusion of the injector.

10. The ink refilling method for a cartridge of an ink jet printer as claimed in claim 7, wherein the predetermined amount of ink in the step of regulating(S5) is in the range of 2 to 10 cc.

11. The ink refilling method for a cartridge of an ink jet printer as claimed in claim 7, further comprising the steps of:

(S7) providing an exhaust holder which includes an inserting protrusion coupled to the enclosing protrusion of the injector and is formed with an ink exhaust passage at the inserting protrusion, after demounting the cartridge from the refill holder;

(S8) mounting the cartridge to the exhaust holder such that the nozzle of the cartridge communicates with the ink exhaust passage of the exhaust holder;

(S9) inserting the ejecting protrusion of the injector into the ink exhaust passage of the exhaust holder;

(S10) extracting a predetermined amount of ink from the cartridge through the nozzle by drawing the piston from the ejecting protrusion; and (S11) demounting the cartridge from the exhaust holder.

12. The ink refilling method for a cartridge of an ink jet printer as claimed in claim 11, wherein in the step of inserting(S9), the enclosing protrusion of the injector is located at a front end of the inserting protrusion of the exhaust holder, and the inserting protrusion is contactingly inserted into the enclosing protrusion by the teeth-engagement of a female screw formed on the inner periphery of the enclosing protrusion and a male screw formed on the outer periphery of the inserting protrusion by revolving the injector.

13. The ink refilling method for a cartridge of an ink jet printer as claimed in claim 12, wherein the step of inserting (S9) includes a step of forcedly coupling a suppressing hoop around the enclosing protrusion of the injector.

14. The ink refilling method for a cartridge of an ink jet printer as claimed in claim 11, wherein the predetermined amount of ink in the step of extracting(S10) is in the range of 2 to 10 cc.

* * * * *